US005860308A

United States Patent [19]

Wu

[11] Patent Number: 5,860,308

[45] Date of Patent: Jan. 19, 1999

[54] AUXILIARY BENDING DEVICE FOR A SPRING-MAKING MACHINE

[76] Inventor: Chin-Tu Wu, P.O. Box 82-144, Taipei, Taiwan

[21] Appl. No.: 912,167

[22] Filed: Aug. 15, 1997

[51] Int. Cl.[6] ..... B21F 35/02

[52] U.S. Cl. ..... 72/137

[58] Field of Search ..... 72/135, 137, 138, 72/140, 142, 143, 145, 41, 43

[56] References Cited

U.S. PATENT DOCUMENTS 5,452,598 9/1995 Cheng ..... 72/140

5,454,249 10/1995 Kempf et al. ..... 72/137

5,732,583 3/1998 Itaya ..... 72/137

*Primary Examiner*—Joseph J. Hail, III

*Assistant Examiner*—Rodney Butler

*Attorney, Agent, or Firm*—A & J

[57] ABSTRACT

An auxiliary bending device for a spring-making machine having a slide includes a supporting frame adapted to be fastened on a slide of a spring-making machine, a driving mechanism fixedly mounted on the supporting frame and provided with a vertical axle, a bending head force-fitted on the vertical axle and provided with at least two upwardly extending pins for bending a spring wire, whereby the process for making springs can be facilitated.

3 Claims, 7 Drawing Sheets

AUXILIARY BENDING DEVICE FOR A SPRING-MAKING MACHINE

CROSS-REFERENCE

This invention is related to U.S. Pat. No. 4,947,670, owned by the same inventor.

BACKGROUND OF THE INVENTION

1. Field of the Invention

This invention is related to an auxiliary bending device for a spring-making machine and in particular to one which can facilitate the process for making springs.

2. Description of the Prior Art

It has been found that the spring-making machine disclosed in U.S. Pat. No. 4,947,670 (see FIGS. 1 and 2), owned by the same inventor, includes a panel 100 on which is mounted a chuck 101 and eight sets of tool guiding means 102 on each of which there is a slide 103 for mounting a tool 104. The slide 103 is driven by a feeding mechanism 105. However, it is necessary to use a special tool and take a complicated process for such a spring-making machine to bend a spring wire perpendicular to the panel 100 thereby increasing the manufacturing cost.

Therefore, it is an object of the present invention to provide an auxiliary bending device for a spring-making machine which can obviate and mitigate the above-mentioned drawbacks.

SUMMARY OF THE INVENTION

This invention is related to an auxiliary bending device for a spring-making machine.

It is the primary object of the present invention to provide an auxiliary bending device for a spring-making machine which can facilitate the process for making springs.

It is another object of the present invention to provide an auxiliary bending device for a spring-making machine which can increase the efficiency of a spring-making machine.

It is still another object of the present invention to provide an auxiliary bending device for a spring-making machine which can be conveniently and rapidly mounted on a spring-making machine.

It is still another object of the present invention to provide an auxiliary bending device for a spring-making machine which is simple in construction.

It is a further object of the present invention to provide an auxiliary bending device for a spring-making machine which is of easy maintenance.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

DETAILED DESCRIPTION OF THE PREFERRED EMBODIMENT

Figure 1:
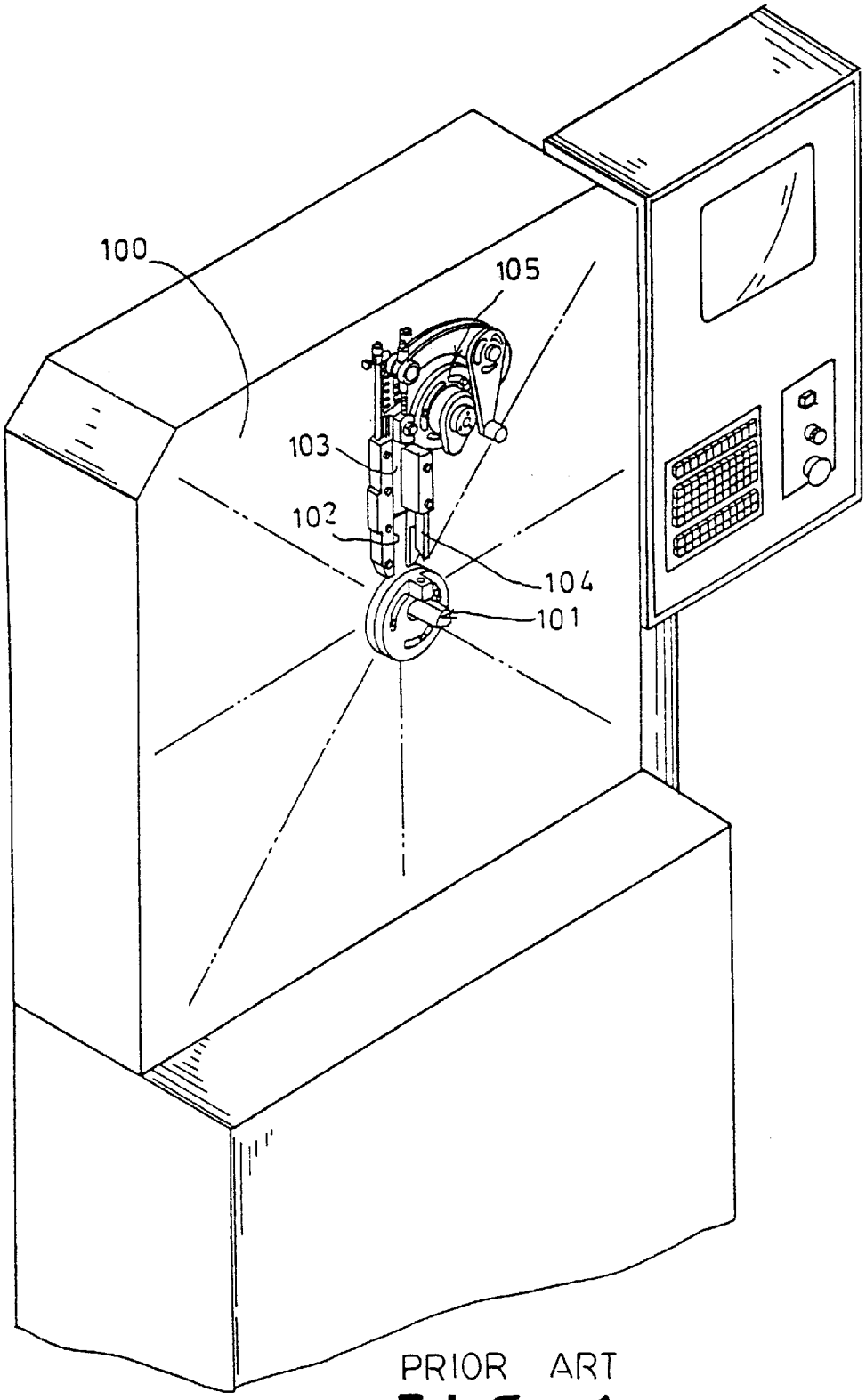
PRIOR ART FIG. 1
FIG. 1 is a perspective view of a prior art spring-making machine.

For the purpose of promoting an understanding of the principles of the invention, reference will now be made to the embodiment illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
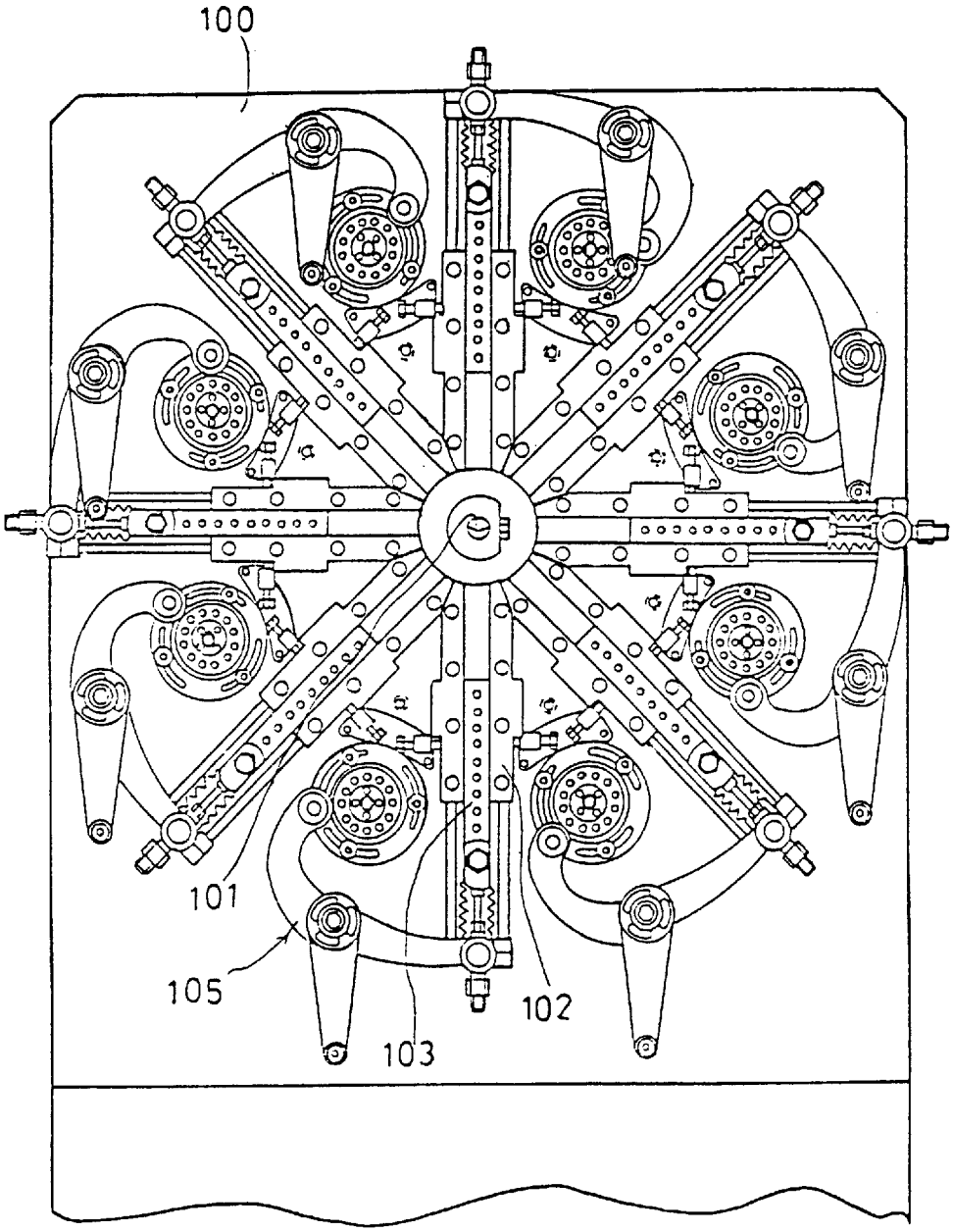
PRIOR ART FIG. 2
FIG. 2 illustrates the distribution of eight sets of tool guiding means on a panel of the prior art spring-making machine of FIG. 1.

With reference to the drawings and in particular to FIGS. 3, 4, 5, 6 and 7, the auxiliary bending device for a spring-making machine according to the present invention generally comprises a supporting frame 1 fixedly arranged on a slide 103 of a spring-making machine (see FIGS. 1 and 2), a driving mechanism 2 fixedly mounted on the supporting frame 1 and provided with a vertical axle 20, and a bending head 3 fitted on the vertical axle 20 and having at least two upwardly extending pins 32 for bending a spring wire S as desired.

The supporting frame 1 includes a vertical bracket 11 and a horizontal bracket 12, wherein the former has a lateral side 110 formed with a plurality of horizontal holes 111 and an upper end formed with a plurality of vertical threaded holes 112, and the latter has a plurality of first slots 121 at its left end (with respect to FIG. 3) so that the latter can be fixedly mounted on the former by screws 10 extending through the slots 121 and into the vertical threaded holes 112. The horizontal bracket 12 is formed with a plurality of second slots 122 at its two sides for installing the driving mechanism 2 and an elongated opening 123 at its central portion for receiving the vertical axle 20 of the driving mechanism 2. The other side of the horizontal bracket 12 has a transverse threaded hole 124 engaged with an adjusting screw 24 having a head 24*a*. A screw 25 extends through the front side of the horizontal bracket 12 to contact with the adjusting screw 24. In short, the adjusting screw 24 can be locked at a fixed position by the screw 25.

The driving mechanism 2 includes a motor 221, a pinion 222, a gear 201, an upper plate 21 and a lower plate 22. The upper plate 21 is formed with a plurality of vertical threaded holes 212 around its circumference, a raised elongated portion 213 at the central portion adapted to be slidably fitted within the elongated opening 123 of the horizontal bracket 12, a vertical circular opening 211 going through the raised elongated portion 213 in which is fitted a bushing or bearing 211*a*. The upper plate 21 is fixedly mounted on the bottom of the horizontal bracket 12 by screws 210 extending downwardly through the second slots 122 of the former and the threaded holes 212 of the latter. The raised elongated portion 213 of the upper plate 21 has a transverse hole 213*a* adapted to receive an outer end of the adjusting screw 24 so that the relative position of the raised elongated portion 213 of the upper plate 21 with respect to the horizontal bracket 12 can be easily regulated by adjusting the adjusting screw 24. The upper plate 21 has a hole 26 which is engaged with a connector 261 through which lubrication oil can be fed to the vertical axle 20, the gear 201 and the pinion 222. The lower plate 22 is formed with a hole in which is fitted the lower end of the vertical axle 20. The gear 201 is mounted on the vertical axle 20 and located on the top of the lower plate 22. The motor 221 is secured to the bottom of the lower plate 22 and has an output shaft (shown but not numbered) extending upwardly through the lower plate 22 to engage with a pinion 222 which is meshed with the gear 201 so that when the motor 221 is powered, the pinion 222 will rotate the gear 201 which will turn the vertical axle 20 to rotate the bending head 3. The upper plate 21 is bolted on the lower plate 22 with the vertical axle 20 extending upwardly through the bearing 211*a* fitted in the raised elongated portion 213 of the upper plate 21. A sensor 23 is arranged on the bottom of the lower plate 22 for detecting the position of the vertical axle 20.

Figure 3:
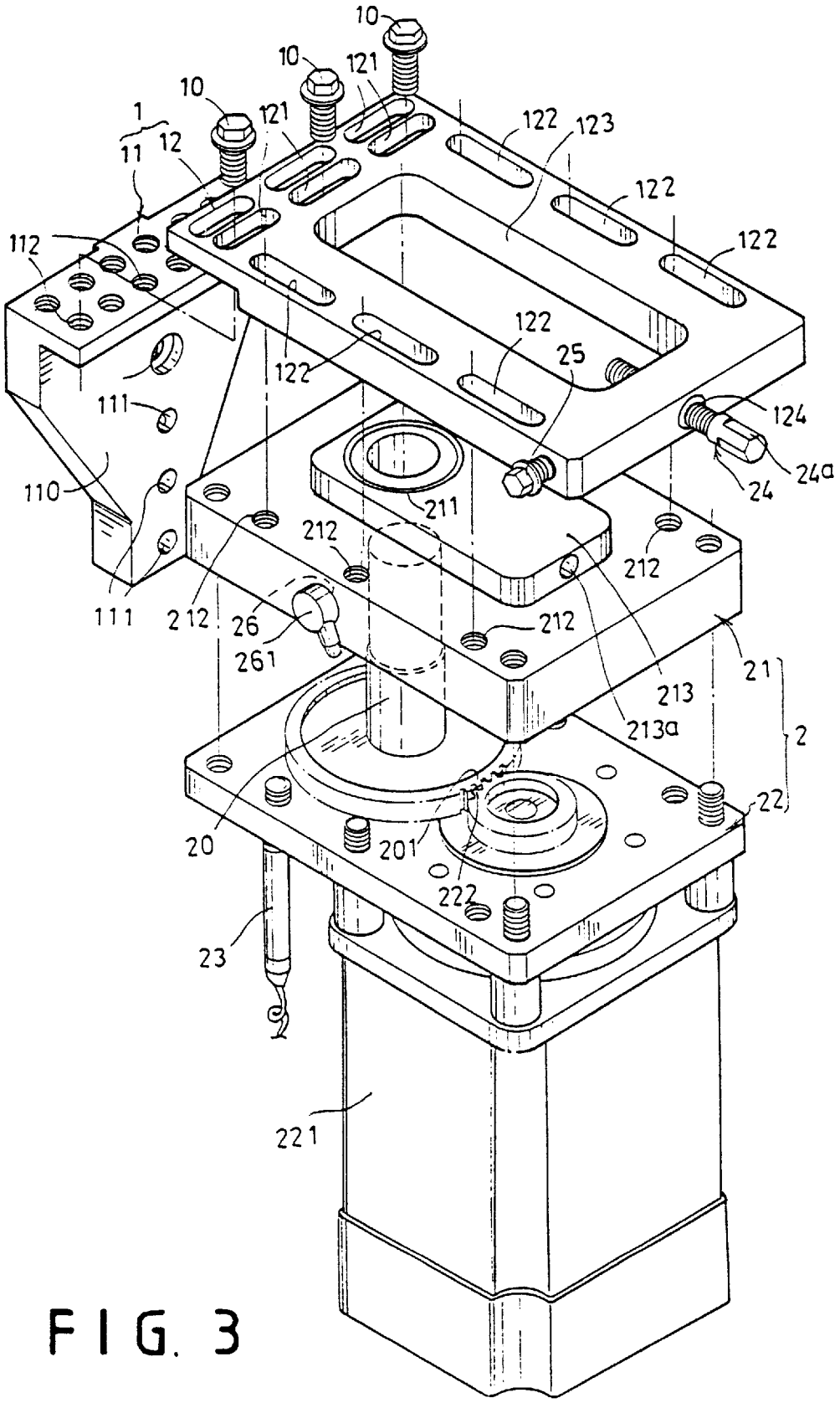
FIG. 3 is an exploded view of an auxiliary bending device for a spring-making machine according to the present invention.
Figure 4:
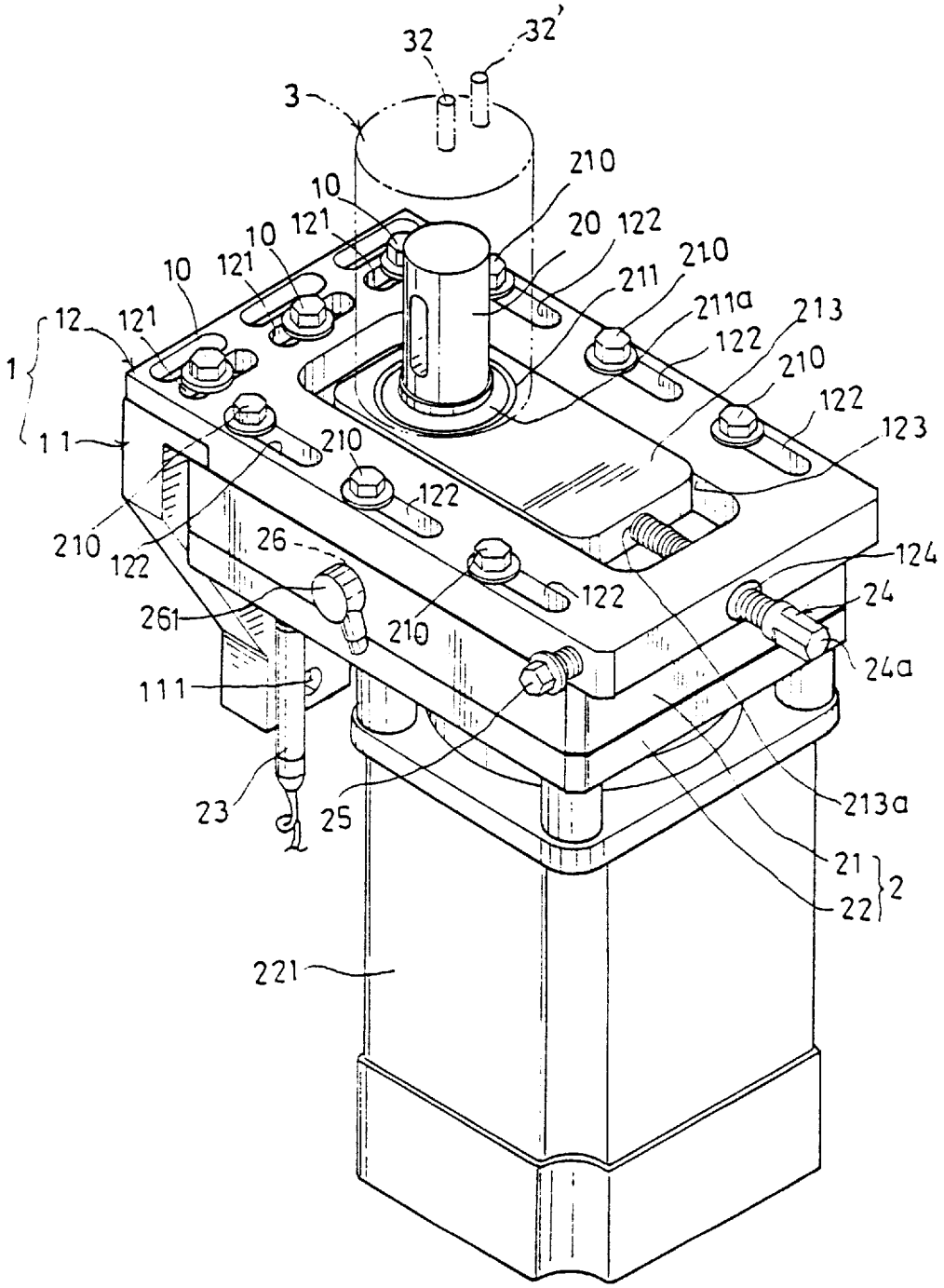
FIG. 4 is a perspective view of the present invention.
Figure 5:
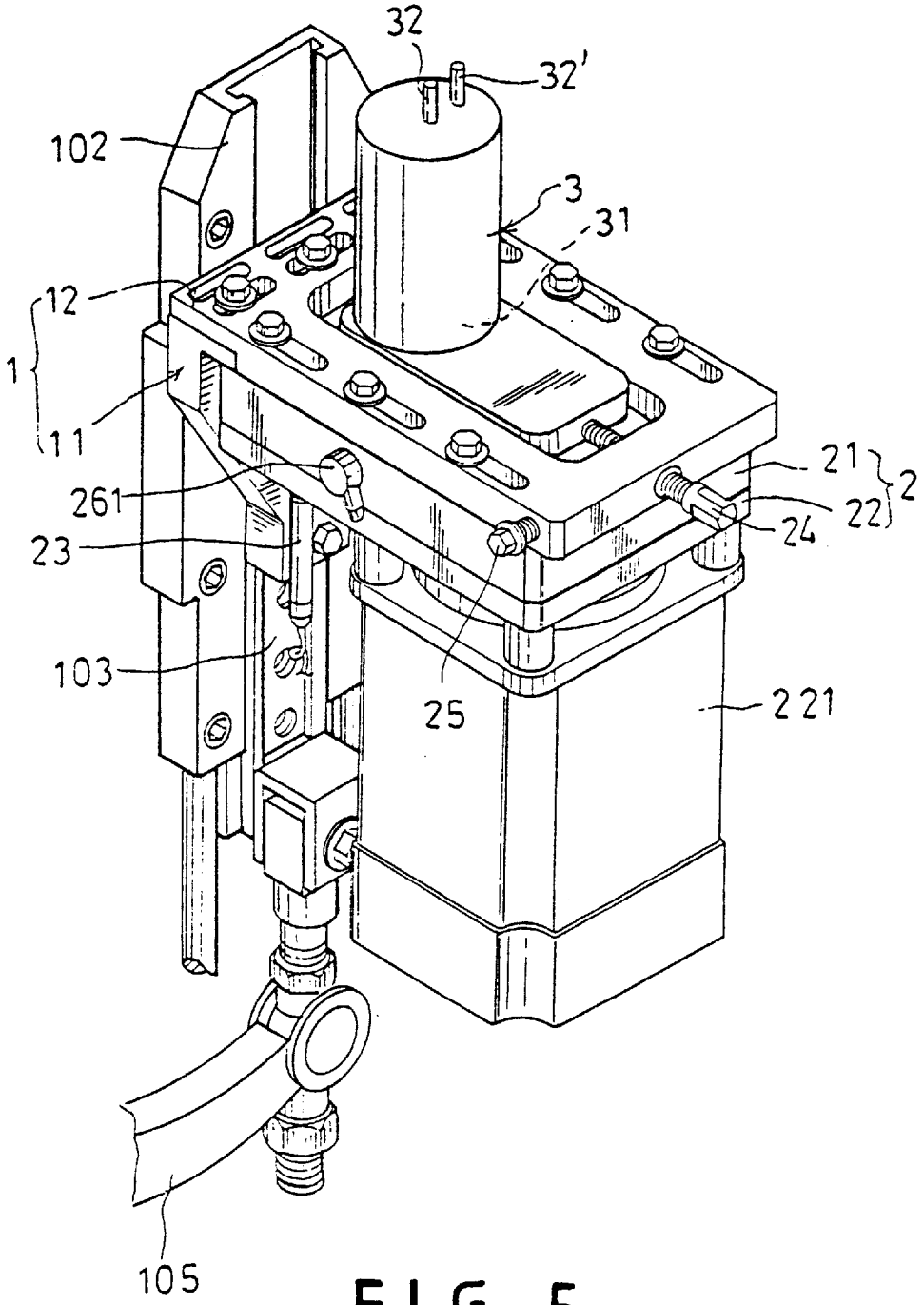
FIG. 5 illustrates how to mount the present invention on a slide of a spring-making machine.
Figure 6:
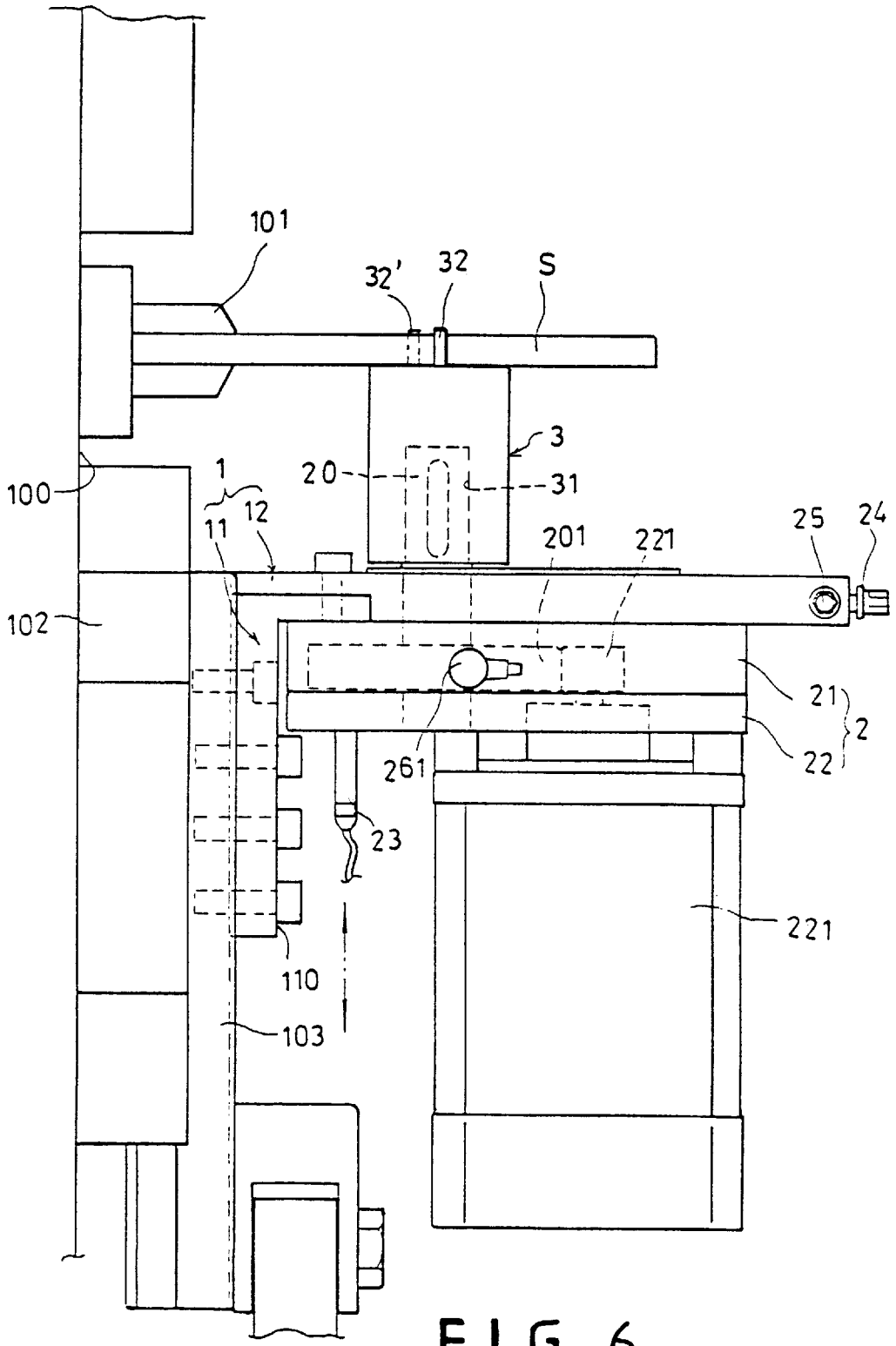
FIG. 6 is a side view illustrating the engagement between the present invention and the spring-making machine.
Figure 7:
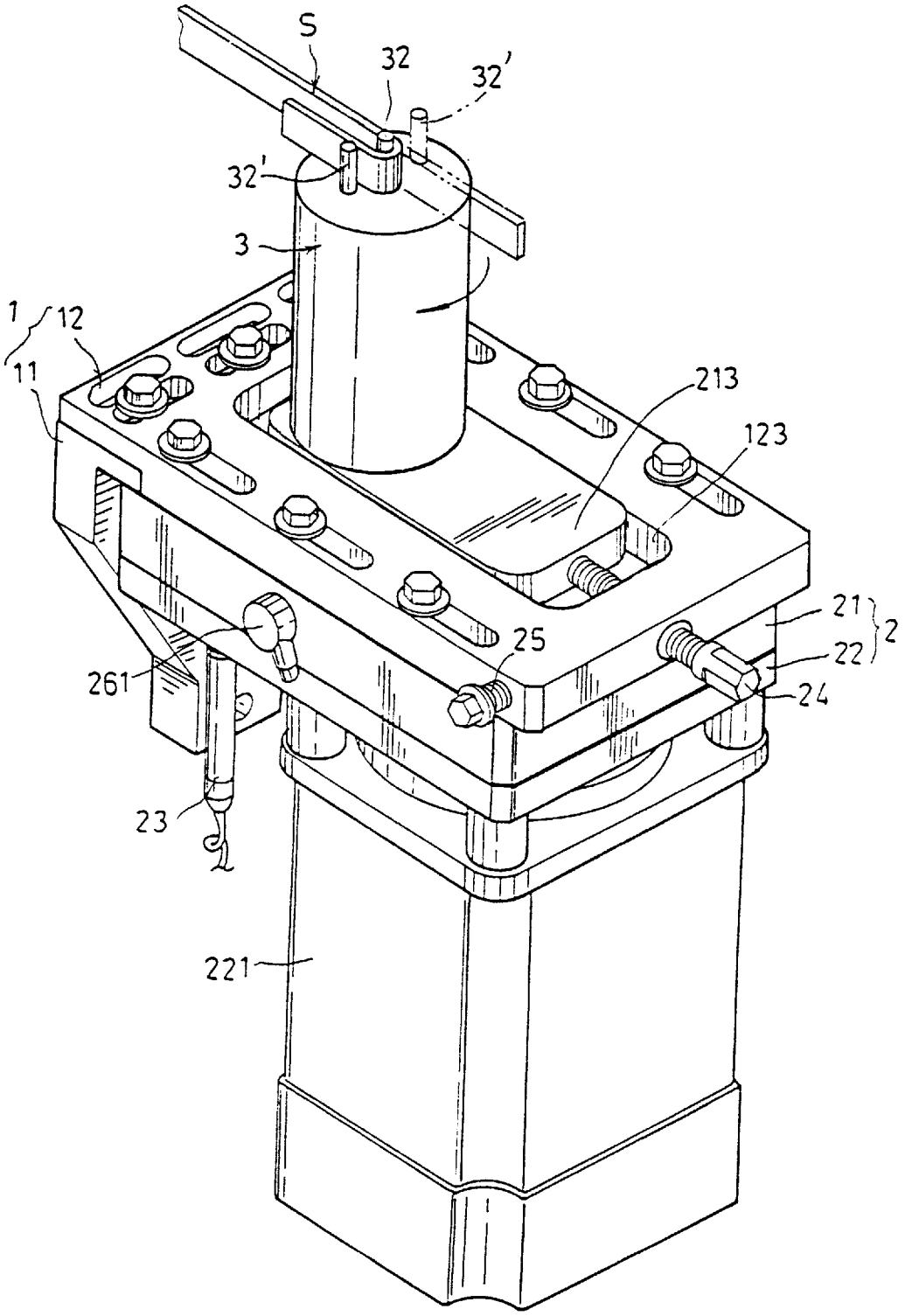
FIG. 7 illustrates the working principle of the present invention.

Referring to FIG. 3 and 5, the bottom of the bending head 3 has a hole 31 in which is force-fitted the upper portion of the vertical axle 20 thereby drivingly connecting the bending head 3 to the motor 221. The bending head 3 is provided with at least two upwardly extending pins 32 and 32' at the upper end by means of which a spring wire S can be curved as desired (see FIG. 7).

When in use, the supporting frame 1 is first fastened on a slide 103 of a spring-making machine. Then, the screws 10 for connecting the vertical bracket 11 to the horizontal bracket 12 are loosened and the horizontal bracket 12 is adjusted in position relative to the driving mechanism 2 and the bending head 3. Further, it is also possible to loosen the screw 25 and turn the adjusting screw 24 to regulate the driving mechanism 2 and the bending head 3 relative to the horizontal bracket 12 in position. Thereafter, when the spring-making machine is powered, the slide 103 of the spring-making machine will be moved together with the auxiliary bending device according to the present invention upwardly by the feeding mechanism 105 of the spring-making machine so that the spring wire S extending out of the chuck 101 of the spring-making machine (see FIGS. 1, 2 and 6) and is fitted between the two pins 32 and 32' of the bending head 3 of the auxiliary bending device and then curved by the bending head 3 as designed. The spring-making machine may be of any design well known to those skilled in the art and is not considered a part of the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An auxiliary bending device for a spring-making machine having a slide comprising:

a supporting frame adapted to be fastened on a slide of a spring-making machine;

a driving mechanism fixedly mounted on said supporting frame and provided with a vertical axle; and a bending head force-fitted on said vertical axle and provided with at least two upwardly extending pins for bending a spring wire;

said supporting frame comprising a vertical bracket and a horizontal bracket, said vertical bracket being formed with a plurality of transverse holes and an upper end formed with a plurality of vertical threaded holes, said horizontal bracket having a plurality of first slots at an end and fixedly mounted on said vertical bracket by screws extending through said first slots and said vertical threaded holes, said horizontal bracket further having a plurality of second slots at two sides thereof for installing said driving mechanism and an elongated opening receiving said vertical axle.

2. The auxiliary bending device for a spring-making machine as claimed in claim 1, wherein said driving mechanism comprises a motor, a pinion, a gear, an upper plate, a lower plate and a sensor, said upper plate being formed with a plurality of vertical threaded holes around a circumferential portion thereof, a vertical circular opening going through a raised elongated portion in which is fitted a bearing, said upper plate being fixedly mounted on a bottom of said horizontal bracket by screws extending downwardly through said second slots and said threaded holes, said gear being mounted on said vertical axle and located on a top of said lower plate, said motor being secured to a bottom of said lower plate and having an output shaft extending upwardly through said lower plate to engage with said pinion which is meshed with said gear, and said sensor being arranged on a bottom of said lower plate for detecting position of said vertical axle.

3. The auxiliary bending device for a spring-making machine as claimed in claim 6, wherein said upper plate has a raised elongated portion at a central portion thereof adapted to be slidably fitted within said elongated opening of said horizontal bracket, said horizontal bracket having a transverse threaded hole engaged with an adjusting screw, a screw extending through said horizontal bracket to contact with said adjusting screw, said raised elongated portion having a transverse hole adapted to receive an outer end of said adjusting screw.

* * * * *